United States Patent [19]

Mims

[11] 4,173,173

[45] Nov. 6, 1979

[54] CARTON ERECTOR

[76] Inventor: Herman D. Mims, Charlotte, N.C.

[21] Appl. No.: 855,134

[22] Filed: Nov. 28, 1977

[51] Int. Cl.[2] ..... B31B 1/50

[52] U.S. Cl. ..... 93/51 R

[58] Field of Search ..... 93/51 R, 51 M, 53 SD, 93/59 R, 59 CE, 59 RS

[56] References Cited

U.S. PATENT DOCUMENTS

| | | | |
|---|---|---|---|
| 3,376,797 | 4/1968 | Scace | 93/51 R |
| 3,521,530 | 7/1970 | Pierce | 93/51 R |

*Primary Examiner*—E. F. Desmond

*Attorney, Agent, or Firm*—Sughrue, Rothwell, Mion, Zinn and Macpeak

[57] ABSTRACT

A vertical carton erecting machine of the stationary die-reciprocal plunger type in which the knife edges for opening the carton slots and receiving the tabs are fixedly mounted on the plunger. Cam-operated flippers press the top edges of the carton outwardly to cause the tabs and slots to interlock. Carton strippers stationarily mounted at the bottom of the die may then engage the carton and strip it from the plunger as the latter is withdrawn.

10 Claims, 5 Drawing Figures

FIG. 1
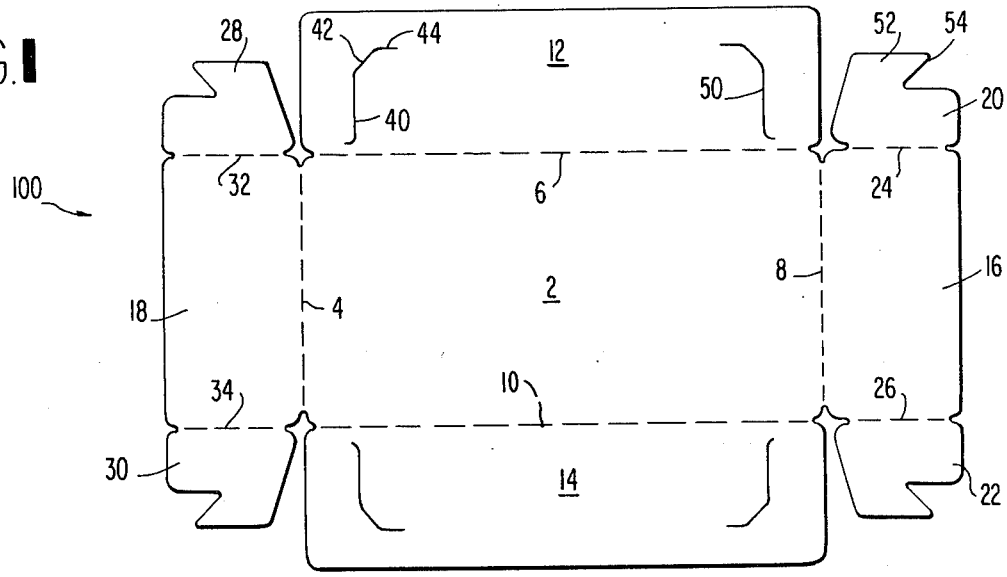
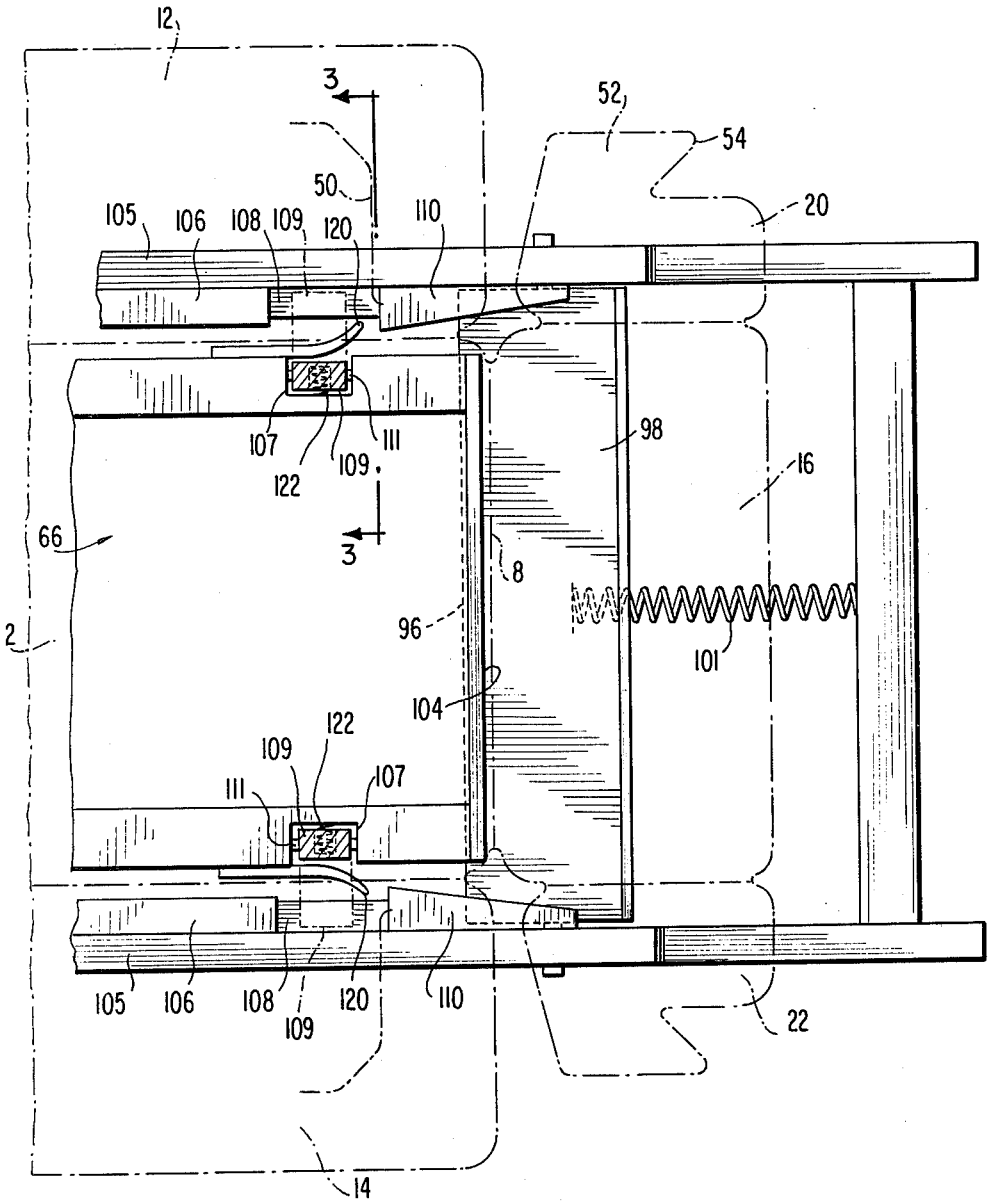
FIG. 2

CARTON ERECTOR

BACKGROUND OF THE INVENTION

Devices are known in the prior art to fold and interlock foldable sections of a flat carton blank to form an erected carton suitable as a container for numerous materials. One broad class of carton erecting machines is the vertical die and plunger type. In general, a reciprocal plunger moving through an "up and down" cycle in a vertical plane forces a flat carton blank through a forming die open at both top and bottom. The sides of the die whether stationary or movable in whole or in part, fold the side and end panels of the blank around the moving plunger as the plunger passes downwardly through the die, thereby erecting the side and end panels relative to the bottom of the box.

Today, where usable for the ultimate containing function, a glueless, interlocking carton will be preferred. Foldable corner lock flaps, each having a tab insertable into a cooperating slot located in an adjacent erected panel, are folded by the cooperating die and plunger, with the last erecting function of the apparatus usually being the locking of the "tab" into its cooperating slot. This is usually accomplished by movable parts on the die and/or plunger which push or pull the tab through the insertion slot. With erection complete, the carton is stripped off the plunger as it changes direction and passes upwardly, back through the die. The carton will then be forwarded to the next step in an integrated packaging operation.

Such a carton erecting machine is described in detail in my prior U.S. Pat. No. 3,859,896 assigned to the same assignee as the present invention. In that carton erecting machine, knife edges, pivotally mounted on the plunger and spring-biased outwardly therefrom, press against the side walls of the carton adjacent the slots, thereby opening the slots to receive their respective tabs. The tabs are each inserted behind the knife edges, each tab having an upper portion which extends above the upper edge of its slot on the outside of the carton. When all of the tabs have been so inserted, the knife edges are caused to move inwardly thereby pulling the tabs, including the upper extending portions thereof, through the side panel slots to form an interlocking engagement. The assembled carton is then removed from the plunger as the latter is withdrawn from the die.

One problem encountered with such a device, is that the inward pulling of the knife edges causes the assembled carton to be rather securely held so that the force required to strip the carton from the plunger is significantly increased.

Furthermore, since the assembled carton is held very closely against the plunger, engagement of the carton by the carton stripper becomes difficult. In order to assure effective engagement of the carton, it is preferable to maintain the carton strippers very close to the lateral surfaces of the plunger but such an arrangement may interfere with the formation of the carton during the downward motion of the plunger. Therefore, it is necessary to use a moving carton stripper which is retracted during the plunger's downward motion and is extended inwardly during the withdrawal of the plunger.

SUMMARY OF THE INVENTION

Accordingly, it is an object of this invention to provide an improved carton erecting machine in which the assembled carton is held at a greater distance from the plunger so that a more simplified carton stripper mechanism may be used.

This is achieved by providing a vertical carton erecting machine in which the knife edges for opening the carton slots are fixedly mounted on the plunger. After the tabs have been inserted behind the knife edges, cam-operated flippers press the top edges of the carton outwardly to cause the tabs and slots to interlock. The flippers remain in position and hold the sides of the assembled carton away from the plunger so that the carton may be easily engaged during the upward stroke of the plunger. The carton stripper mechanism for engaging the carton may be a simple inwardly inclined edge at the bottom of the die which will allow the sides of the carton to slide by in the downward direction only.

BRIEF DESCRIPTION OF THE DRAWINGS

FIG. 1 is a plan view of an interlocking carton erectable by the vertical carton erector according to the present invention;

FIG. 2 is a top partial plan view of the die and cooperating plunger of the carton erector according to the present invention, with an end section of the carton of FIG. 1 shown positioned on the die in dotted lines;

DETAILED DESCRIPTION OF THE PREFERRED EMBODIMENT

Figure 3:
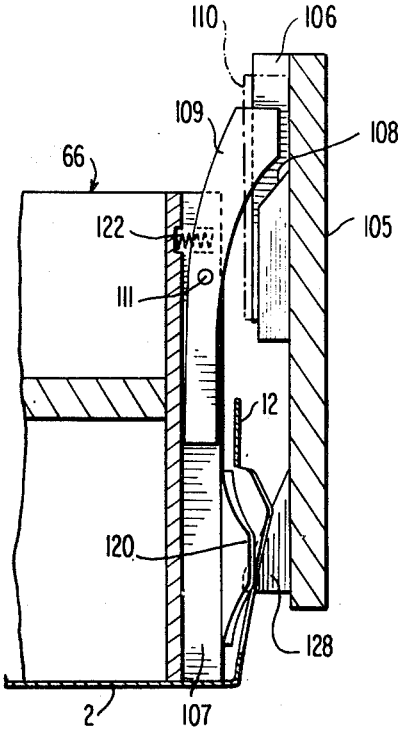
FIG. 3 is a cross-sectional view along lines 3—3 of FIG. 2, immediately prior to the tab-slot interlocking operation.

The carton of FIG. 1 is of the well-known tab-slot interlocking type used in many different industries, for example to enclose bakery goods. The central area 2 of the carton 100 which is defined by fold lines 4, 6, 8 and 10, becomes the bottom of the erected carton. Opposed side panels 12 and 14, and opposed end panels 16 and 18 are shown hinged to the central panel 2 at the above mentioned fold lines. For purposes of forming a generally rectangular carton, the side panels are shown longer than the end panels, but of course the reverse may be or all panels could be of the identical length. Each end panel has an end flap attached to each of its side edges. For example, end 16 has flaps 20 and 22 attached to it by along side edges, which then become fold lines 24 and 26. The same is true for end 18 and its respective end flaps 28 and 30, which are attached thereto, respectively, by fold lines 32 and 34.

The fold lines above mentioned may be of the cut and scored type as is conventional for allowing ease of folding along a given predetermined line. Additionally, fold lines 24 and 32 are either aligned with, or preferably parallel and slightly offset outwardly with respect to the fold line 6 to compensate for the thickness of the sheet material in the folding operation, as is customary in the art. A similar sort of situation wil exist as to fold lines 26 and 34 relative to fold line 10.

Each side panel of the carton 100 toward each end thereof has three connected slits 40, 42 and 44 which combine to form a slot 50. Each end flap includes a tab 52 to be inserted through the adjacent slot 50 to form a corner "lock" during carton erection. As will be more fully explained hereinafter, during carton erection tabs 52 are pushed inwardly through slots 50. Because the uppermost tips 54 are higher than slits 44 in erected condition, once the tabs 52 are fully displaced through the slots 50, they engage the inside of the body of each side panel above the slots and are not easily dislodged back through the slots. The folding and locking process of this type of carton is well known to those skilled in the art.

Figure 4:
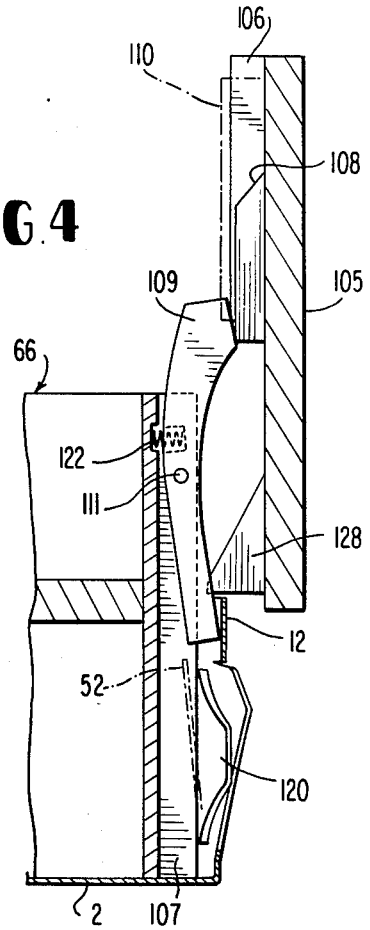
FIG. 4 is a cross-sectional view along lines 3—3 of FIG. 2 immediately after the tab-slot interlocking operation.
Figure 5:
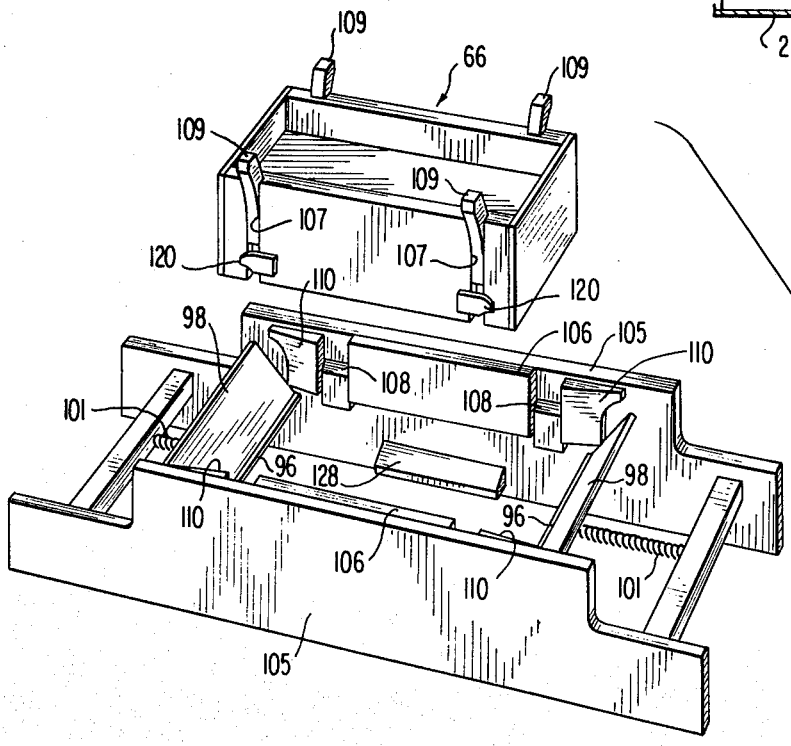
FIG. 5 is a perspective view of the assembled carton erector according to the present invention.

FIGS. 2, 3, 4 and 5 depict in detail the plunger and die including the elements thereof which cooperate to erect and interlock the side and end panels of the carton. FIG. 2 shows a top view of one end of the die and plunger, it being understood that the other end of the shown apparatus, to the left of FIG. 2, would be a mirror image thereof. FIGS. 3 and 4 are cross sectional views along lines 3—3 of FIG. 2 showing the operation of the cooperating die and plunger elements which lock the tab of the end panel into the corresponding side panel slots. FIG. 5 is a perspective view of the assembled carton erector according to the present invention.

With particular reference to FIG. 2, the end panels of the carton blank are erected, in a manner similar to that disclosed in my prior U.S. Pat. No. 3,859,896, through the use of abutment surfaces, one of which is indicated at 96, at either end of the die. Surface 96 may cooperate with or be a part of folding plate 98 which is pivotally mounted at one end of the die. The plate 98 is biased by a compression spring 100 near its base (or, alternatively, a tension spring near its upper edge) so that in its rest position the upper edge of the plate is angled away from the plunger and the abutment surface 96, connected to the lower edge of the plate, extends beyond the edge 104 of the plunger. As the plunger descends through the die, edge 104 presses down on abutment surface 96. This causes folding plate 98 to pivot into an upright position, thereby folding the carton end panel 16 against the end face of the plunger. The above-described technique for folding of the carton end panels does not constitute part of my present invention and a more complete understanding may be had by referring to my above-mentioned U.S. Pat. No. 3,859,896.

Each side of the die includes a backing plate 105 having mounted thereon a single secondary guide 106 positioned between two camming surfaces 108. Primary guides 110 are angled outwardly from each camming surface toward the respective ends of the die to a point at least beyond the end of the plunger, preferably completely overlapping each fold plate 98. Into each side of the plunger 66 a pair of slots 107 are cut, each slot containing a flipper 109 pivotally mounted in the slot by means of a dowel pin 111. As shown in FIG. 3, the upper portion of the flipper 109 is biased outwardly by means of a spring 122. Each side of the plunger 66 carries a pair of thin flexible blades 120 fixedly attached to the plunger and substantially traversing the slots 107. As shown in FIGS. 2 and 3, the blades 120 traverse the slots 107 at a point below the bottoms of flippers 109 so as not to interfere with the operation of the flippers.

The erection and interlocking of a side and end panel of a carton blank of the type depicted in FIG. 1 by the plunger and die arrangement of FIGS. 2–4 will now be described. The upper surface of the secondary guide 106, which is slightly raised as compared with the upper surface of the primary guide 110, which in turn, is higher than end abutment surface 96, initiates folding of the side panel about its fold line. Approximately simultaneously therewith, but fractionally later, folding of the end panel flaps 52,22 about their fold lines is initiated by the portion of primary guides 110 which extend beyond the end of plunger 66. As the side panel is erected, the primary guide 110, the inside portion adjacent the camming surface being closer to the plunger 66 than the secondary 106 (that is, is offset inwardly as compared to the secondary guide) pushes the section of the carton side panel between the camming surface 108 and the end of the plunger inwardly. In other words, as seen best in FIG. 2, the portion of the side panel between the slot 50 and panel edge 51 is the panel area displaced inwardly by the primary guide 110, thereby opening the insertion slot. It should be noted that the center portion of the side panel is not displaced inwardly. This occurs as the angled surface of the primary guide 110 guides the end flap 52 along the outside of the side panel toward the slot. As is shown mostly clearly in FIG. 2, the edge of knife blade 120 extends outwardly slightly more than the inner most portion of the primary guide 110. Through predetermined registration, as the fold plate 98 completes the erection of the end panel, the tab of the end flap is guided by the primary guide to a position just to the inside of the knife blade which by this time is jutting slightly out of the side panel slot. FIG. 3 shows the relative positions of the plunger and die with the carton fully erected. The knife blade 120 protrudes through the side 12 of the carton and the lower portion of the flipper 109 extends below the upper edge of the carton side panel 12. As the plunger continues its downward travel the upper portion of flipper 109 encounters the camming surface 108 which forces the upper portion of the flipper inwardly against the force of bias spring 122, thereby rotating the flipper about pin 111. This pivoting movement causes the bottom of the flipper 109 to press outwardly on the upper edge of the carton side panel 12 immediately above the knife edge 120 so that the end flap tab which is held by the knife edge, is forced through the side panel slot into interlocking engagement therewith. The two flippers on each side of the plunger hold the upper edge of the carton side panel 12 away from the side of the plunger so that when the plunger is withdrawn the carton will be engaged by the carton strippers 128 which extend inwardly from the die on either side of the plunger. The strippers 128 are formed with an angled lower surface in order to aid in pulling the carton away from the plunger. It should be emphasized that the carton strippers 128 are located at beneath the secondary guides 106 on each side of the die, as shown clearly in FIG. 2, and therefore do not interfere with the operation of the knife and/or flipper. The plunger can then be completely withdrawn from the die, another carton blank inserted on the die, and the cycle repeated.

In the above-described carton erecting machine, the blades 120 and carton strippers 128 are fixedly mounted, thereby eliminating the need for complicated blade and/or stripper operating mechanisms. The flipper mechanism is very simple in design and operation, and only a very low camming force is required for flipper operation. An additional advantage of the present invention is that the carton edges are held away from the plunger, rather than against the plunger as in previous machines, thereby facilitating the removal of the carton from the plunger.

What is claimed is:

1. A carton erecting apparatus of the type having a cooperating die and plunger, for erecting cartons of the type having an interlocking tab and slot, said apparatus comprising:

means for engaging said tab and preventing the outward movement thereof; and means for pressing outwardly on said carton adjacent said slot for causing said tab and slot to interlock.

2. A carton erecting apparatus according to claim 1 having a stationary die and reciprocal plunger wherein said means for engaging is a knife blade mounted on said plunger.

3. A carton erecting apparatus according to claim 1 wherein said means for pressing is movable between a retracted first position and an extended second position, said apparatus further comprising:

stripping means for stripping an assembled carton from said plunger, said stripping means comprising an inclined surface fixedly mounted on said die and having an edge which is laterally spaced from said plunger by a lesser amount than said means for pressing when the latter is in its second position.

4. A carton erecting apparatus according to claim 1 wherein said means for pressing is a flipper having first and second ends and pivotally mounted on said plunger.

5. A carton erecting apparatus according to claim 4 further comprising an inclined camming surface mounted on said die for engaging and pressing inwardly the first end of said flipper as the plunger moves through the die, thereby causing the second end of said flipper to press outwardly on said carton.

6. A carton erecting apparatus according to claim 5 having a stationary die and a reciprocal plunger wherein said means for engaging is a knife edge fixedly mounted on said plunger.

7. A carton erecting apparatus according to claim 6 further comprising:

means for stripping said carton from said plunger, said means for stripping comprising an inclined surface fixedly mounted on said die and having an edge which is laterally spaced from said plunger by a lesser amount than said means for pressing when the latter is in its second position.

8. A carton erecting apparatus according to claim 7 wherein said die further comprises stationary primary and secondary guides positioned on either side of said camming surface, and wherein said flipper is pivotally mounted in a cavity in a side wall of said plunger, said knife edge substantially traversing said cavity immediately below said flipper.

9. A carton erecting apparatus according to claim 8 including two camming surfaces on a single side of the die, a secondary guide between said camming surfaces and a primary guide positioned to the other side of each camming surface and angled outwardly toward the respective end of the die, the upper surface of said secondary guide being higher than the upper surface of said primary guides to initiate folding of the side panel of the carton.

10. A carton erecting apparatus according to claim 9 including end fold bars carried by said die to initiate folding of the carton and panels, the angle of each said primary guide being formed so as to guide its respective tab to a position between a knife edge and a side of said plunger.

* * * * *